US005429089A

United States Patent [19]

Thornberg et al.

[11] Patent Number: 5,429,089

[45] Date of Patent: Jul. 4, 1995

[54] AUTOMATIC ENGINE SPEED HOLD CONTROL SYSTEM

[75] Inventors: Christopher A. Thornberg, Newtown; Bryan S. Cotton, Monroe, both of Conn.

[73] Assignee: United Technologies Corporation, Hartford, Conn.

[21] Appl. No.: 226,621

[22] Filed: Apr. 12, 1994

[51] Int. Cl.[6] ..... F02D 31/00

[52] U.S. Cl. ..... 123/352

[58] Field of Search ..... 123/352, 349

[56] References Cited

U.S. PATENT DOCUMENTS

| | | | |
|---|---|---|---|
| 4,958,288 | 9/1990 | Takahashi | 364/426.04 |
| 5,177,683 | 1/1993 | Oo et al. | 123/352 |
| 5,213,077 | 5/1993 | Nishizawa et al. | 123/352 |
| 5,224,045 | 6/1993 | Stassell | 364/431.07 |
| 5,253,626 | 10/1993 | Hatano et al. | 123/352 |
| 5,270,934 | 12/1993 | Kobayashi | 364/426.04 |
| 5,329,455 | 7/1994 | Oo et al. | 123/352 |

*Primary Examiner*—Raymond A. Nelli
*Attorney, Agent, or Firm*—Michael Grillo

[57] ABSTRACT

An automatic engine speed hold control system (430) allows an engine (420) to quickly achieve a commanded engine speed and thereafter maintain a constant commanded engine speed regardless of changes in engine loading. An engine speed error signal (444) is computed as the difference between an operator commanded engine speed (440) and actual engine speed (434,436). The engine speed error signal (444) is scaled based on an engine speed error gain (448), and the scaled engine speed error (452) is then provided via an integral path (456) and a proportional path (454) to a summing junction (478) where it is summed with load anticipation trim signals (474,467) to provide a final trim signal (485). The load anticipation trim signals (474,467) are feed forward signals which anticipate engine response to changes in commanded engine loading, the combined engine trim signal (452) and load anticipation trim signals (474,467) provide an engine speed hold throttle position command (final trim signal) (485) to control fuel flow to the engine (420) and therefore control engine speed. The engine speed error gain (448) is determined based on engine loading (450), and the error gain is thereafter limited (451) based on current engine speed.

24 Claims, 4 Drawing Sheets

AUTOMATIC ENGINE SPEED HOLD CONTROL SYSTEM

TECHNICAL FIELD

The present invention relates to an automatic engine speed hold control system and more particularly to an engine speed hold control system which quickly achieves a commanded engine speed and maintains a constant commanded engine speed regardless of changes in engine loading.

BACKGROUND OF THE INVENTION

Classical linear feedback control systems utilized for automatic engine speed hold control provide commands to change engine speed based on the difference between a commanded and sensed engine speed. Therefore, such systems do not command a change in current throttle position until an engine speed error has occurred.

Certain types of engines, such as a carburetted, rotary engines, operate over wide range of engine speeds and the relationship between engine shaft horse power and throttle position is very non-linear. For such an engine, a purely linear feedback control system does not provide ideal control, particularly for the purposes of providing engine speed hold control. Such a linear feedback control system yields and unacceptably slow response time to system disturbances. The response time of the linear feedback control system may be increased by increasing control gains; however, such increased gains may make the system less stable.

DISCLOSURE OF INVENTION

Objects of the invention include the provision of a automatic engine speed hold control system which quickly achieves a commanded engine speed and maintains a constant commanded engine speed regardless of changes in engine loading.

Another object of the present invention is to provide an automatic engine speed hold control system for an engine which operates over a wide range of engine speeds for minimizing the response time to changes in commanded engine speed and commanded engine loads.

A further object of the present invention is to provide an automatic engine speed hold control system which anticipates changes in engine loading to thereby minimizes variations in engine speed due to changes in engine loading.

According to the present invention, an engine speed error signal is computed as the difference between an operator commanded engine speed and actual engine speed, the engine speed error signal is scaled based on an engine speed error gain, and the scaled engine speed error signal is then provided via an integral path and a proportional path to a summing junction where it is summed with load anticipation trim signals to thereby provide a final engine trim signal.

In further accord with the present invention, the load anticipation trim signals are feed forward signals which anticipate engine response to changes in commanded engine loading, the combined scaled engine speed error signal (engine trim signal) and load anticipation trim signals provide an engine speed hold throttle position command (final engine trim signal) to control fuel flow to the engine and therefore control engine speed.

In still further accord with the present invention, the engine speed error gain is determined based on engine loading, and the error gain is thereafter limited based on current engine speed.

The present invention provides a significant improvement over the prior art by incorporating tile advantages of quick response time to commanded inputs from feed forward load anticipation trim signals while maintaining the control gains at ideal levels for the current engine operating conditions. The control gains and therefore the stability of the system is not compromised to improve response time. The feed forward signals act as anticipators and immediately command the throttle servo to reposition a fuel metering valve to tile appropriate throttle positions based on commanded load changing inputs. This provides a fast engine response as opposed to the slow response of a full authority controller which must wait until an engine speed error is generated based on changing commands and then integrate up to a new trim point. Additionally, utilization of scheduled gains for the engine speed governor ensures that the control laws are utilizing the ideal gains for the present engine operating conditions.

The foregoing and other objects, features and advantages of the present invention will become more apparent in light of the following detailed description of exemplary embodiments thereof as illustrated in the accompanying drawings.

BEST MODE FOR CARRYING OUT THE INVENTION

The automatic engine speed hold control system of the present invention is particularly well suited for allowing an engine to quickly achieve a commanded engine speed and thereafter maintain a constant commanded engine speed regardless of changes in engine loading. The automatic engine speed hold control system of the present invention will be described with respect to a carburetted, rotary engine used on a UAV, such as the UAV illustrated in FIG. 1. Such an engine operates over a wide range of engine speeds, and tile relationship between engine shaft horsepower and throttle position is non-linear. However, it will be understood by those skilled in the art that the control of the present invention is applicable to any type of engine which operates over a wide range of engine speeds and/or wherein the relationship between engine shaft horse power and throttle position is non-linear.

Figure 1:
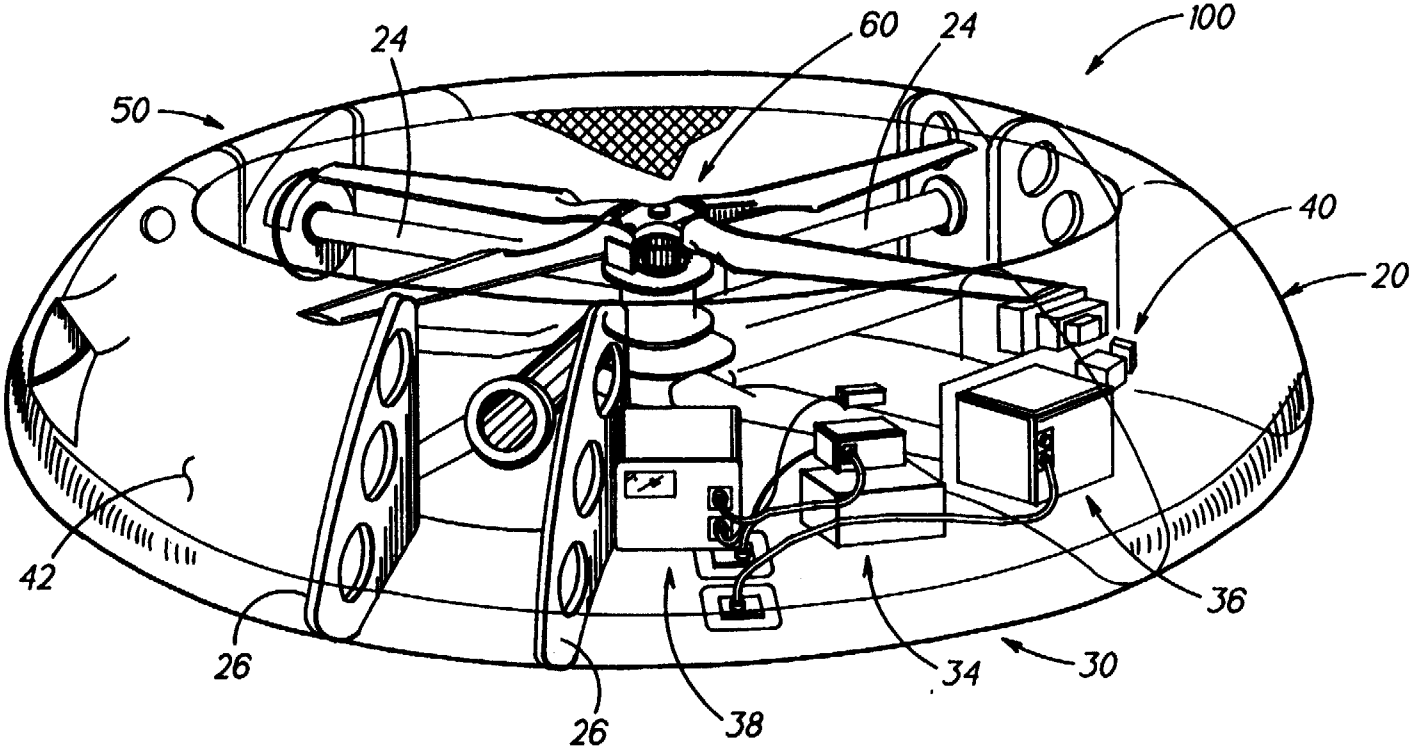
FIG. 1 is a perspective view, partially broken away, of an unmanned aerial vehicle (UAV) having an engine speed hold control system of the present invention.

Referring to FIG. 1, one embodiment of a UAV 100 is shown. The UAV used in the example of tile present invention comprises a toroidal fuselage or shroud 20 having an aerodynamic profile, flight/mission equipment 30, a power plant subsystem 50, and a rotor assembly 60. The toroidal fuselage 20 is provided with a plurality of support struts 24 which are attached to the rotor assembly 60 and are operative to support the rotor assembly 60 in fixed coaxial relation with respect to the toroidal fuselage 20. The toroidal fuselage 20 contains forward located internal bays 26 which are typically utilized for sundry flight/mission equipment 30 as described herein below. Flight/mission equipment 30 such as avionics 34, navigation equipment 36, flight computer 38, communications gear 40 (for relaying real time sensor data and receiving real time command input signals), antenna 42, etc., are distributed in the various internal bays 26 as shown in example in FIG. 1. Distribution of the various flight/mission equipment 30 is optimized in conjunction with the placement of a power plant subsystem 50 within the toroidal fuselage 20.

The flight/mission equipment 30 described thus far is exemplary of the type which may be used in a UAV. However, as will be understood by those skilled in the art, a separate flight control computer, avionics, and navigation system are not necessarily required in order to perform the functions identified in the present invention. Alternatively, a single flight control computer or mission computer may be provided to perform the above identified functions.

Figure 2:
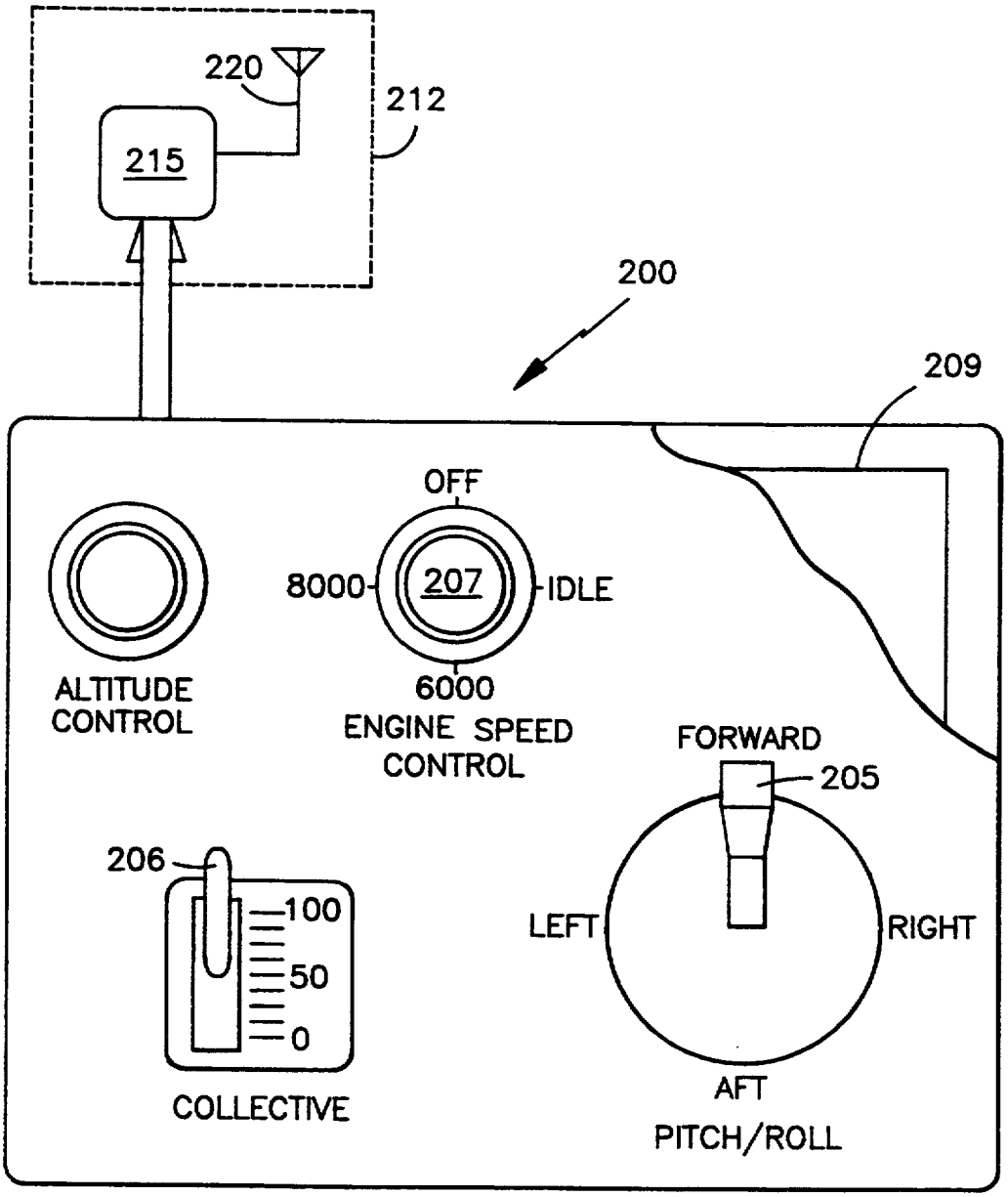
FIG. 2 is a perspective view, partially broken away, of an operator control panel used with the remotely operated vehicle of FIG. 1.

Referring to FIG. 2, a control panel 200 for remote operator control of the UAV 100 (FIG. 1) is shown. The control panel provides control signals to the UAV to control the UAV engine and UAV control surfaces to thereby direct the flight of the UAV. In the present example, the most significant load on the engine relates to the collective command provided to the rotor blades. By increasing the collective pitch of the rotor blades, the amount of lift or thrust produced by the blades is increased. Similarly, by reducing the rotor blade collective pitch, the amount of thrust being produced by the rotor blades is reduced. Additionally, for a given collective pitch setting or command, the load on the engine may be significantly increased or decreased by increasing or decreasing engine speed, respectively. Another significant engine load is the rotor blade cyclic pitch. The cyclic pitch of the rotor blades is changed to allow control of the UAV flight direction. The control panel 200 is provided with a cyclic control stick 205 for providing cyclic control inputs. The cyclic control stick 205 is shown as being a two axis control stick wherein forward and aft movements of the control stick relate to pitch, and side-to-side movements of the control stick relate to roll. A collective control stick 206 is provided to change the collective pitch of the UAV rotor blades, and engine speed control 207 is provided for controlling the UAV engine speed. The engine speed control provides the desired engine speed (engine speed reference) at which the UAV engine attempts to operate. A control panel computer 209 is provided for receiving the control commands provided by the cyclic control stick 205, the collective control stick 206, and the engine speed control 207, and converting them into signals to be transmitted via communications equipment 212. The communications equipment 212 comprises a transmitter 215 for receiving the control commands provided from tile control panel computer 209 and for transmitting the control commands via a control panel antenna 220.

Figure 3:
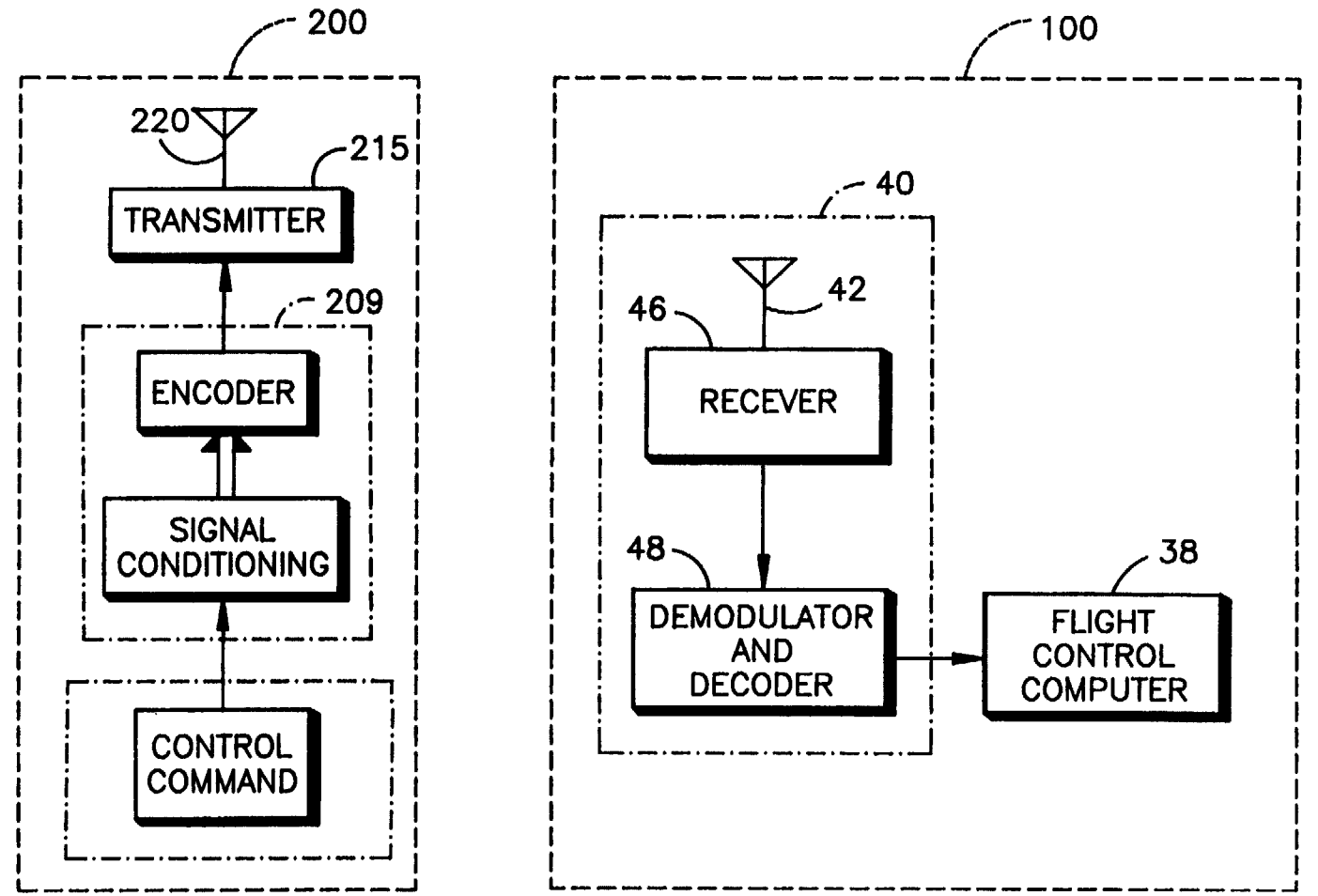
FIG. 3 is a schematic block diagram showing the transmission of control signals from the operator control panel of FIG. 2 to the remotely operated vehicle of FIG. 1.

Referring now to FIG. 3, when control signals are transmitted by the control panel via tile antenna 220, the signals are received by the UAV antenna 42 and thereafter provided to the UAV communications equipment 40. The communications equipment comprises a receiver 46 and a demodulator/decoder 48 for receiving and decoding the received signals transmitted by the control panel. Thereafter, the demodulated and decoded control signals are provided to the flight control computer 38. The flight control computer 38 processes the incoming control signals to thereby provide the appropriate engine speed control inputs and control surface commands to the UAV control surfaces to perform the desired maneuvers.

Figure 4:
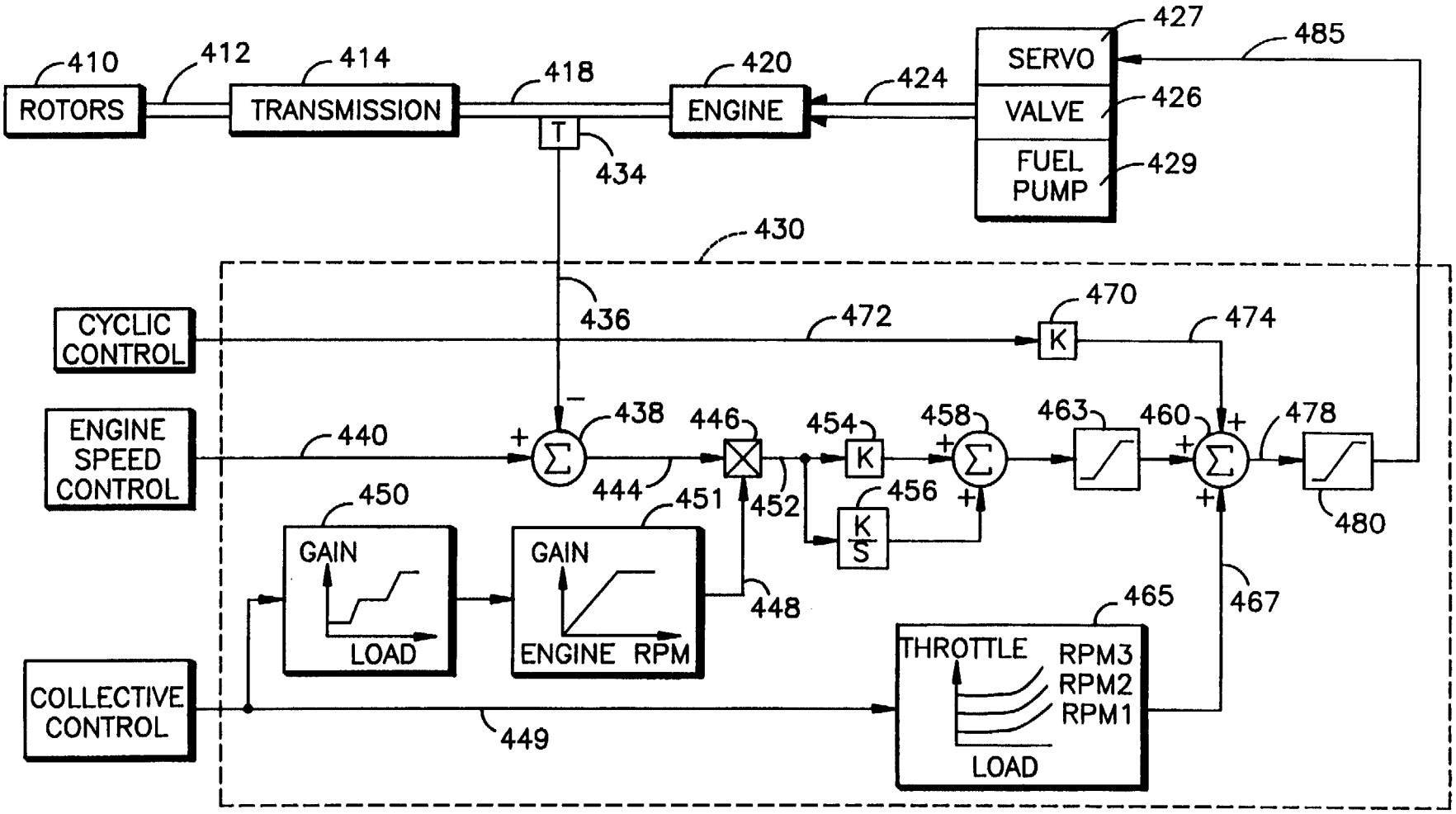
FIG. 4 is a schematic block diagram of the engine speed hold control system of the present invention.

Referring to FIG. 4, rotors 410 are connected through a shaft 412 to a gearbox 414 (transmission) which is driven by an output shaft 418 of an engine 420. During engine operation, fuel is applied to the engine by fuel inlet lines 424 from a fuel metering valve 426. A throttle servo 427 controls the position of the metering valve 426 so as to cause the correct amount of fuel from a fuel pump 429 to be applied to the fuel inlet lines 424.

Everything described thus far is provided by way of example and is exemplary of the type of engine and engine operating environment (engine loading) the automatic engine speed hold control system of the present invention is designed to operate with.

An automatic engine hold control system 430 provides engine speed hold throttle position commands (final engine trim signals) to the throttle servo 427 to thereby control the metering valve 426. The automatic engine hold control system 430 typically tries to provide the correct rate of fuel flow in the fuel inlet lines 424 so as to maintain a desired engine speed as determined by a tachometer 434 which measures the speed of the engine 420 (such as on the output shaft 418). The tachometer 434 provides an engine speed indicating signal on a line 436 to a summing junction 438. The other input to the summing junction 438 is a commanded engine speed signal (from the operator control station) on a line 440. The output of the summing junction 438 is a speed error signal on a line 444 which is applied to a multiplication function 446.

The other input to the multiplication function 446 is an engine speed error gain signal on a line 448. The speed error gain is determined by applying the collective command (from tile operator control station) on a line 449 to a gain function 450. The gain function 450 provides a gain signal based on the magnitude of the collective signal. Thereafter, the gain is applied to a limit function 451 which limits the magnitude of the gain based on engine RPM. The output of the limit function 451 is the engine speed error gain signal on the line 448. The result of combining the gain function 450 and the limit function 451 is to provide a scheduled gain, the magnitude of which is limited based on current engine RPM.

The output of the multiplication function 446 is a scaled engine speed error signal on a line 452 which is provided via a proportional path containing a gain function 454 and an integral path containing an integral function 456 to a summing junction 458. The scaled engine speed error is fed via a proportional and integral path to provide an increasing or decreasing throttle position command to bring the engine speed error to zero. The output of the summing junction 458 is an engine trim signal which is applied to a summing junction 460 via a limiter 463. The other inputs to the summing junction 460 are load anticipation trim signals provided to maintain a constant engine speed in response to a change in engine load. In the present example, there are two rotor commands which cause a change in engine load, the first being a change in rotor collective, and the second being a change in rotor cyclic angle or pitch.

The load anticipation trim signal contribution in response to collective and engine RPM commands is provided by a throttle map function 465. The throttle map function 465 contains a map of the trimmed throttle positions for a series of engine speeds and at a series of collective trims (percent collective). The throttle map 465 generates the anticipated approximate throttle position trim value required for the combination of commanded engine speed and collective setting. The map uses linear interpolation to determine the throttle positions for combinations of commanded engine speed and collective setting that are not explicitly defined in the map. The mapping method acts as a collective and engine speed command anticipator and allows the engine speed hold control system to quickly achieve the desired trim while minimizing engine surging or lagging in response to a changing collective command or a changing engine RPM. The output of the throttle map 465 is provided on a line 467 to the summing junction 460.

The other input to the summing junction 460 is a load anticipation trim signal contribution based on cyclic commands. It has been found that the throttle anticipation required in response to a cyclic command may be modeled by a generally linear function, and therefore, a gain function 470 is utilized to convert a cyclic pitch command on a line 472 (from the operator control station) into a load anticipation trim signal contribution on a line 474 which is provided to the summing junction 460. The cyclic pitch command on the line 472 utilizes the total cyclic pitch commanded by the pitch and roll control axes as an input. The cyclic pitch anticipator reduces engine speed fluctuations due to changes in commanded cyclic pitch on the rotor system. The output of the summing junction 460 is provided on a line 478 to an output limiter 480. The output limiter ensures that the throttle command does not exceed its operating region, e.g., 0% to 100%.

The output of the limiter 480 is the engine speed hold throttle position command (final engine trim signal) on a line 485 which is provided to the throttle servo 427. The majority of the final engine trim signal is provided by the load anticipation trim signals to thereby provide engine speed command anticipation in response to changing engine load to allow the engine speed hold control system to quickly achieve and maintain the desired trim while minimizing engine surging and/or lagging.

The advantages of the cyclic and collective anticipation is that the throttle servo is commanded to the appropriate throttle position immediately based on commanded inputs. Although a throttle map 465 is used in response to collective and engine RPM commands and the cyclic command is applied via a scaling or gain function 470, it will be understood by those skilled in the art that the type of anticipation provided will be based on the response of the engine to the load of interest. In certain applications, the cyclic contribution may be so small as to be de minimus and not be required. Additionally, although the collective/engine RPM throttle map functions are shown as exponential functions, the particular shape of the function will depend on the response of the engine to changes in the load of interest.

The engine speed error gain is shown as being dependent only upon the change in collective or percent collective commanded, and thereafter limited based on engine speed. However, it will be understood by those skilled in the art that the engine speed error gain may be a function of total engine load, or as in the present example, the engine load that makes the primary or overwhelming contribution.

Although the present example has been described in context of an unmanned aerial vehicle having a carburetted, rotary engine, it will be understood by those skilled in the art that the engine control of the present invention is applicable to different types of vehicles and engines as desired. What is important is that the engine speed vary over a large range and/or the relationship between engine shaft horsepower and throttle position vary in a non-linear manner.

Although the invention has been described and illustrated with respect to exemplary embodiments thereof, it should be understood by those skilled in the art that the foregoing and various other changes, omissions, and additions may be made therein and thereto without departing from the spirit and scope of the present invention.

We claim:

1. An automatic engine speed hold control system for automatically controlling the speed of an engine having at least one load, said system comprising:

means for providing load control signals for controlling the application of said loads to said engine;

engine control means for providing an engine trim signal indicative of fuel flow required for engine operation at a desired trim speed, and for metering fuel flow to said engine in response to said engine trim signal;

means responsive to said load control signals for providing anticipation trim signals indicative of the anticipated fuel flow required to maintain engine operation at said desired trim speed in response to said load control signals; and said engine control means comprising means for providing said engine trim signal with an anticipation trim component in response to said anticipation trim signals.

2. An automatic engine speed hold control system according to claim 1 further comprising:

means for providing a desired trim signal indicative of said desired trim speed;

means for providing an engine speed signal indicative of the speed of said engine;

speed error means responsive to said desired trim signal and said engine speed signal for providing an engine speed error signal indicative of the difference there between;

speed error gain means responsive to said load control signals for providing an engine speed error gain signal indicative of a scheduled gain, based on current engine loading; and said engine control means being responsive to said engine speed error signal and said engine speed error gain signal for providing said engine trim signal.

3. An automatic engine speed hold control system according to claim 1 further comprising means responsive to said engine speed signal and said speed error gain signal for limiting the magnitude of said speed error gain signal based on current engine speed.

4. An automatic engine speed hold control system according to claim 1 wherein said anticipation trim signals vary linearly with respect to changes in said load control signals.

5. An automatic engine speed hold control system according to claim 1 further comprising:

means for providing an engine speed signal indicative of the speed of said engine; and said means responsive to said load control signals comprises a look-up table, said anticipation trim signals being obtained from said look-up table based on said load control signals and said engine speed signal.

6. An automatic engine speed hold control system according to claim 1 further comprising:

means for providing an engine speed signal indicative of the speed of said engine;

modeling means for modeling the response of said engine to changes in said load control signals for various values of said engine speed signal; and said means responsive to said load control signals determining the value of said anticipation trim signals from said modeled engine response based on said load control signals and said engine speed signal.

7. An automatic engine speed hold control system for automatically controlling the speed of an engine having at least one load, said system comprising:

means for providing load control signals for controlling the application of said loads to said engine;

means for providing a desired trim signal indicative of a desired trim speed of said engine;

means for providing an engine speed signal indicative of the speed of said engine;

speed error means responsive to said desired trim signal and said engine speed signal for providing an engine speed error signal indicative of the difference there between;

speed error gain means responsive to said load control signals for providing an engine speed error gain signal indicative of a scheduled gain, based on current engine loading; and engine control means responsive to said engine speed error signal and said engine speed error gain signal for providing an engine trim signal indicative of fuel flow required for engine operation at said desired trim speed, and for metering fuel flow to said engine in response to said engine trim signal.

8. An automatic engine speed hold control system according to claim 7 further comprising means responsive to said engine speed signal and said speed error gain signal for limiting the magnitude of said speed error gain signal based on current engine speed.

9. An automatic engine speed hold control system according to claim 8 further comprising:

means responsive to said load control signals for providing anticipation trim signals indicative of the anticipated fuel flow required to maintain engine operation at said desired trim speed in response to said load control signals; and said engine control means comprising means for providing said engine trim signal with an anticipation trim component in response to said anticipation trim signals.

10. An automatic engine speed hold control system according to claim 9 wherein said anticipation trim signals vary linearly with respect to changes in said load control signals.

11. An automatic engine speed hold control system according to claim 9 further wherein said means responsive to said load control signals comprises a look-up table, said anticipation trim signal being obtained from said look-up table based on said load control signals and said engine speed signal.

12. An automatic engine speed hold control system according to claim 9 further comprising:

modeling means for modeling the response of said engine to changes in said load control signals for various values of said engine speed signal; and said means responsive to said load control signals determining the value of said anticipation trim signals from said modeled engine response based on said load control signals and said engine speed signal.

13. A method for automatically controlling the speed of an engine having at least one load comprising the steps of:

providing load control signals for controlling the application of said loads to said engine;

providing an engine trim signal indicative of fuel flow required for engine operation at a desired trim speed;

metering fuel flow to said engine in response to said engine trim signal;

providing anticipation trim signals indicative of the anticipated fuel flow required to maintain engine operation at said desired trim speed in response to said load control signals; and providing said engine trim signal with an anticipation trim component in response to said anticipation trim signals.

14. The method of claim 13 further comprising the steps of:

providing a desired trim signal indicative of said desired trim speed;

providing an engine speed signal indicative of the speed of said engine;

determining an engine speed error signal indicative of the difference between said desired trim signal and said engine speed signal;

determining an engine speed error gain signal based on the magnitude of said load control signals; and determining the magnitude of said engine trim signal as the product of said engine speed error signal and said engine speed error gain signal.

15. The method of claim 14 further comprising the step of limiting the magnitude of said engine speed error gain signal based on said engine speed signal.

16. The method of claim 13 wherein said anticipation trim signals vary linearly with respect to changes in said load control signals.

17. The method of claim 13 further comprising the steps of:

providing an engine speed signal indicative of the speed of said engine; and obtaining the value of said anticipation trim signal from a look-up table based on said load control signals and said engine speed signal.

18. The method of claim 13 further comprising the steps of:

providing an engine speed signal indicative of the speed of said engine;

modeling the response of said engine to changes in said load control signals for various engine speeds;

storing said modeled engine response; and determining the value of said anticipation trim signal from said modeled engine response based on said load control signals and said engine speed signal.

19. A method for automatically controlling the speed of an engine having at least one load comprising the steps of:

providing load control signals for controlling the application of said loads to said engine;

providing a desired trim signal indicative of a desired trim speed of said engine;

providing an engine speed signal indicative of the speed of said engine;

determining an engine speed error signal indicative of the difference between said desired trim signal and said engine speed signal;

determining an engine speed error gain signal based on the magnitude of said load control signals;

determining the magnitude of an engine trim signal as the product of said engine speed error signal and said engine speed error gain signal, said engine trim signal being indicative of fuel flow required for engine operation at said desired trim speed, and metering fuel flow to said engine in response to said engine trim signal.

20. The method of claim 19 further comprising the step of limiting the magnitude of said engine speed error gain signal based on said engine speed signal.

21. The method of claim 20 further comprising the steps of:

providing anticipation trim signals indicative of the anticipated fuel flow required to maintain engine operation at said desired trim speed in response to said load control signals; and providing said engine trim signal with an anticipation trim component in response to said anticipation trim signals.

22. The method of claim 21 wherein said anticipation trim signals vary linearly with respect to changes in said load control signals.

23. The method of claim 21 further comprising the step of obtaining the value of said anticipation trim signal from a look-up table based on said load control signals and said engine speed signal.

24. The method of claim 21 further comprising the steps of:

modeling the response of said engine to changes in said load control signals for various engine speeds;

storing said modeled engine response; and determining the value of said anticipation trim signal from said modeled engine response based on said load control signals and said engine speed signal.

* * * * *